US008281944B2

(12) United States Patent
Battegazzore

(10) Patent No.: US 8,281,944 B2
(45) Date of Patent: Oct. 9, 2012

(54) ANTI-TAMPER CLOSURE

(75) Inventor: Piero Battegazzore, Alessandria (IT)

(73) Assignee: Guala Closures S.p.A., Alessandria (IT)

( * ) Notice: Subject to any disclaimer, the term of this patent is extended or adjusted under 35 U.S.C. 154(b) by 546 days.

(21) Appl. No.: 12/513,066

(22) PCT Filed: Oct. 29, 2007

(86) PCT No.: PCT/IB2007/003367

§ 371 (c)(1),
(2), (4) Date: May 15, 2009

(87) PCT Pub. No.: WO2008/056227

PCT Pub. Date: May 15, 2008

(65) Prior Publication Data

US 2009/0321378 A1 Dec. 31, 2009

(30) Foreign Application Priority Data

Nov. 10, 2006 (EP) ..... 06425765

(51) Int. Cl.

| | |
|---|---|
| ***B65D 55/02*** | (2006.01) |
| ***B65D 41/00*** | (2006.01) |
| ***B65D 41/62*** | (2006.01) |
| ***B65D 41/34*** | (2006.01) |
| ***B65D 51/18*** | (2006.01) |
| ***B65D 51/20*** | (2006.01) |

(52) U.S. Cl. ..... 215/219; 215/251; 215/252; 215/253; 215/258; 215/277; 215/334; 220/254.1; 220/254.8; 220/256.1; 220/257.1

(58) Field of Classification Search ..... 215/219, 215/251, 252, 253, 258, 277, 334; 220/254.1, 220/354.8, 256.1, 257.1; 29/248
See application file for complete search history.

(56) References Cited

U.S. PATENT DOCUMENTS

| | | | | |
|---|---|---|---|---|
| 6,929,137 | B1 * | 8/2005 | Granger et al. | 215/252 |
| 7,922,018 | B2 * | 4/2011 | Granger et al. | 215/349 |

FOREIGN PATENT DOCUMENTS

| | | |
|---|---|---|
| GB | 1 203 704 | 9/1970 |
| WO | WO 83/04402 | 12/1983 |
| WO | WO 00/63089 | 10/2000 |
| WO | WO 03/066467 | 8/2003 |

* cited by examiner

*Primary Examiner* — Anthony Stashick
*Assistant Examiner* — Madison L Wright
(74) *Attorney, Agent, or Firm* — Jonathan D. Ball; King & Spalding

(57) ABSTRACT

The present invention relates to an anti-tamper closure (1, 1') for threaded bottles (100, 100') comprising an outer cap (20, 20') and an outer skirt (22, 22') which is connected to the outer cap (20, 20') prior to initial opening, and an inner cap (30, 30') and an inner annular element (32, 32') which is connected to the inner cap (30, 30') prior to initial opening, in which the inner annular element (32, 32') is connected to the inner cap (30, 30') with respect to both rotation and translation by inner connection means (31, 31') which render the inner annular element (32, 32') free to rotate and to translate relative to the inner cap (30, 30') after initial opening.

22 Claims, 6 Drawing Sheets

ANTI-TAMPER CLOSURE

TECHNICAL FIELD

The present invention relates to a pre-threaded anti-tamper closure and to a method of producing such a closure.

BACKGROUND OF THE INVENTION

The containers that are concerned in the present invention, for example, bottles, generally have a threaded neck for direct engagement by the internal thread of the closure and, below the thread, a projection for the engagement of anti-tamper means that are present on the closure.

Traditionally, short or long closures are fitted on the containers, according to the type of product contained; short closures are suitable for beverages for mass consumption whereas long closures are generally used for more expensive beverages such as, for example, alcoholic drinks.

Long closures in fact provide a security seal which, is visibly longer than a normal ring and therefore adequately "dresses" the neck of the bottle so that, for example, decorations or inscriptions can be applied thereto.

Conventional a closures comprise an outer metal capsule connected to a pre-threaded inner element. Such closures comprise a security seal which, after initial opening, provides evidence that the initial opening of the bottle has taken place.

In known closures, when the outer metal element contributes to the formation of the security seal, the manufacturing process becomes expensive since it is necessary to provide for a step for the bending of the outer metal capsule after the inner pre-threaded element has been inserted therein.

In view of the described prior art, the object of the present invention is to provide a long anti-tamper closure which can be fitted on containers by a screwing operation alone and which does not require processing operations of the metal capsule after the inner pre-threaded element has been fitted in the metal capsule.

SUMMARY OF THE INVENTION

According to the present invention, this object is achieved by means of an anti-tamper closure for containers having a neck and a mouth with an outer thread on the neck and with a projection disposed below the thread, the closure comprising an outer capsule comprising an outer cap and an outer skirt, and an inner pre-threaded element suitable for closing the mouth of the container, comprising an inner cap having an inner thread suitable for engaging the outer thread of the container and an inner annular element, in which the outer cap is connected to the inner cap in a manner such as to allow the closure to be opened and closed normally, the outer skirt is connected to the outer cap by outer connection means which, after initial opening, render the outer skirt free to rotate and to translate relative to the outer cap, the inner annular element is connected to the inner cap by inner connection means which, after initial opening, render the inner annular element free to rotate and to translate relative to the inner cap, the inner annular element is connected to the outer skirt with respect to translation by retaining means projecting towards the interior of the closure, and the outer skirt extends longitudinally towards the container beyond the retaining means, preferably for at least 3 mm or for at least 5 mm and by means of a method of producing such an anti-tamper closure comprising the steps of producing the outer capsule, producing the inner pre-threaded element, inserting the inner pre-threaded element in the outer capsule, without comprising any manufacturing step after the insertion step.

BRIEF DESCRIPTION OF THE DRAWINGS

The characteristics and the advantages of the present invention will become clear from the following detailed description of a practical embodiment, which is given by way of non-limiting example, with reference to the appended drawings, in which.

DETAILED DESCRIPTION

When, in the course of this description, reference is made to the upward and downward directions these should be understood as referring to the normal position of the container with the mouth facing upwards and not as limiting of the embodiment described.

Similarly, the longitudinal direction should be understood as the direction defined by the screwing of the closure of the present invention onto its container.

Figure 1:
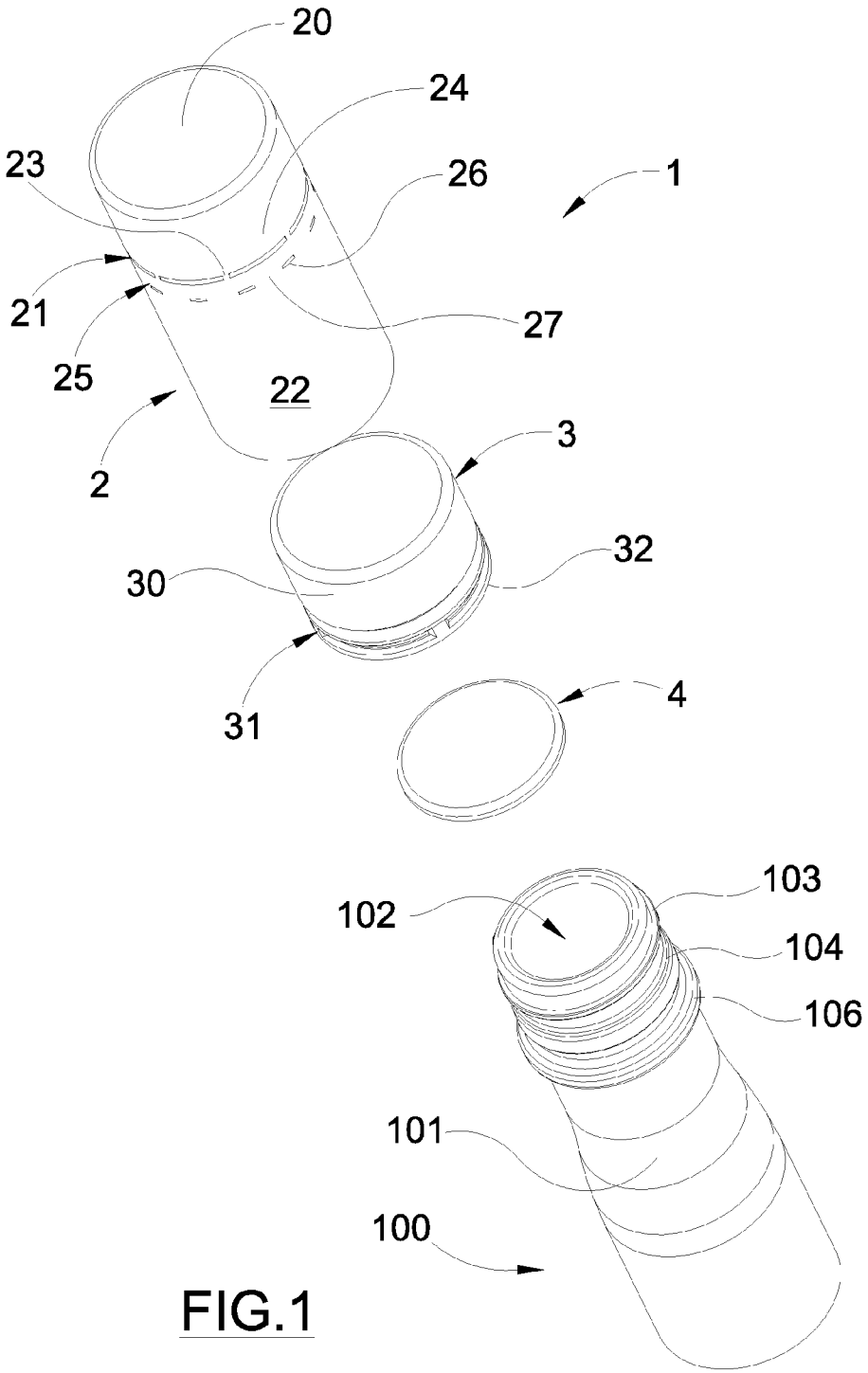
FIG. 1 is an exploded perspective view of a closure according to a preferred embodiment of the present invention.

With reference to FIG. 1, a container, for example a bottle, is indicated 100 and has a neck 101 and a mouth 102. Both an outer thread 103 and a projection 104 having a lower abutment surface 105 are formed on the neck 101 of the container 100. The neck also comprises a second, lower projection 106 the outside diameter of which is approximately equal to the inside diameter of the closure, indicated 1.

The closure 1 comprises an outer capsule 2 and an inner pre-threaded element 3. An insert 4, fixed internally to the inner pre-threaded element 3 and having the function of ensuring improved sealing of the closure 1 against the container 100 may also optionally be provided. The insert 4 and the methods of fixing it to the inner pre-threaded element 3 are known in the art and will not be described further.

The outer capsule 2 comprises an outer cap 20 and an outer skirt 22 which are connected to one another by outer connection means 21 such that, prior to initial opening, the outer cap 20 is connected for translation and preferably also for rotation with the outer skirt 22 and, after initial opening, the outer cap 20 is released from the outer skirt 22 with respect both to rotation and to translation.

In the embodiment of FIG. 1, for example, the outer connection means are formed by breakable bridges 23 which alternate with incisions 24, preferably rectangular incisions 24, in the outer skirt 22. From three to eight bridges 23 may be formed on the outer skirt 22, for example, there may be five or six bridges 23 preferably having an overall angular extent of less than 15°.

The incisions 24 advantageously define tongues 28, which are advantageously inclined towards the interior of the closure 1, preferably by a distance at least equal to the thickness of the outer skirt.

The inner pre-threaded element 3 comprises an inner cap 30 and an inner annular element 32 which are connected to one another by inner connection means 31 such that, prior to initial opening, the inner cap 30 is connected for translation and preferably also for rotation with the inner annular element 32 and, after initial opening, the inner cap 30 is released from the inner annular element 32 with respect to both rotation and translation.

According to a preferred embodiment, the inner connection means are formed by breakable bridges 33.

The inner cap 30 comprises an inner thread 34 for engaging the outer thread 103 of the container 100.

The outer cap 20 is connected to the inner cap 30 so as to permit normal opening and closure of the container.

The inner annular element 32 comprises engagement means suitable for achieving an anti-tamper engagement with the neck 101 of the container 100 without the need for any operation other than simply the screwing of the closure 1 onto the container 100.

Advantageously, the engagement means are snap-engagement means and comprise one or more engagement tongues 35 for engaging against the abutment surface 105. These tongues 35 are formed in a manner such that, during screwing-on, the outer surface of the projection 104 urges them into a deformed configuration which permits the downward movement of the closure 1 onto the container 100; after the tongues 35 have passed over the lower surface 105, they snap back to their rest configuration in which they can come into abutment with the surface 105 and effectively prevent the removal of the closure 1 from the container 100.

The inner annular element 32 advantageously comprises from two to six tongues 35, for example, three or four tongues 35.

Figure 4:
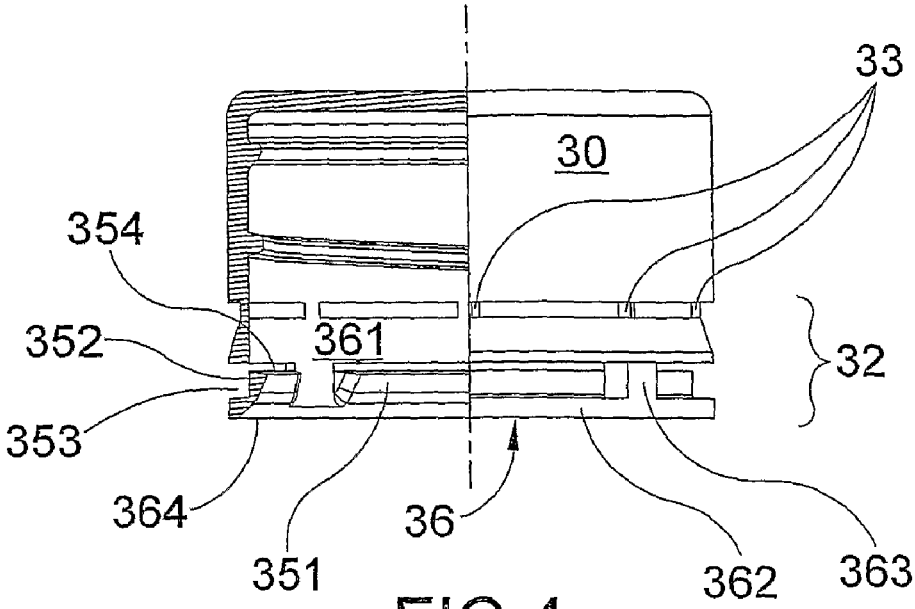
FIG. 4 is a partially-sectioned view of an element of the closure of FIG. 1.

With reference to the embodiment of FIG. 4, the inner annular element 32 comprises a frame 36 which comprises an upper, ring-shaped end portion 361 and a lower, similarly ring-shaped end portion 362 which are connected to one another by bridges 363 that have sufficient mechanical strength to ensure the anti-tamper function.

The breakable bridges 33 are advantageously connected to the upper ring 361.

Figure 5:
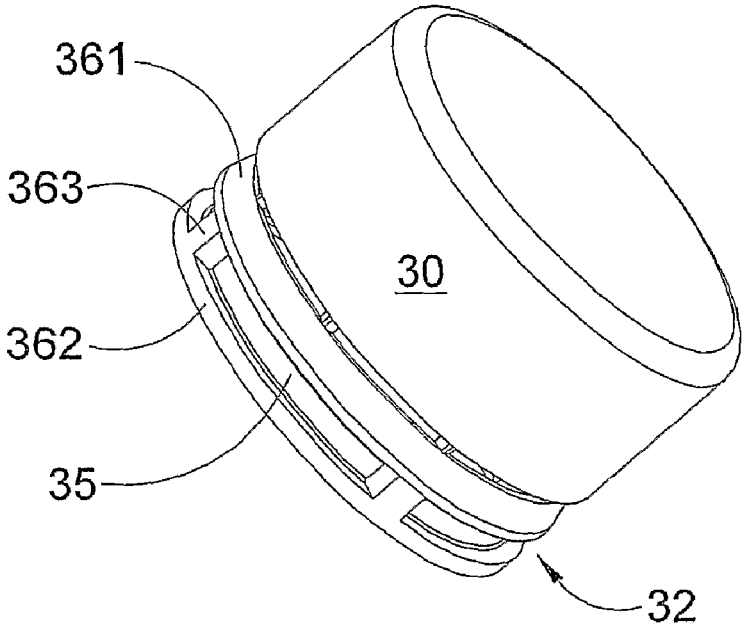
FIG. 5 is a perspective view of the element of FIG. 4.
Figure 6:
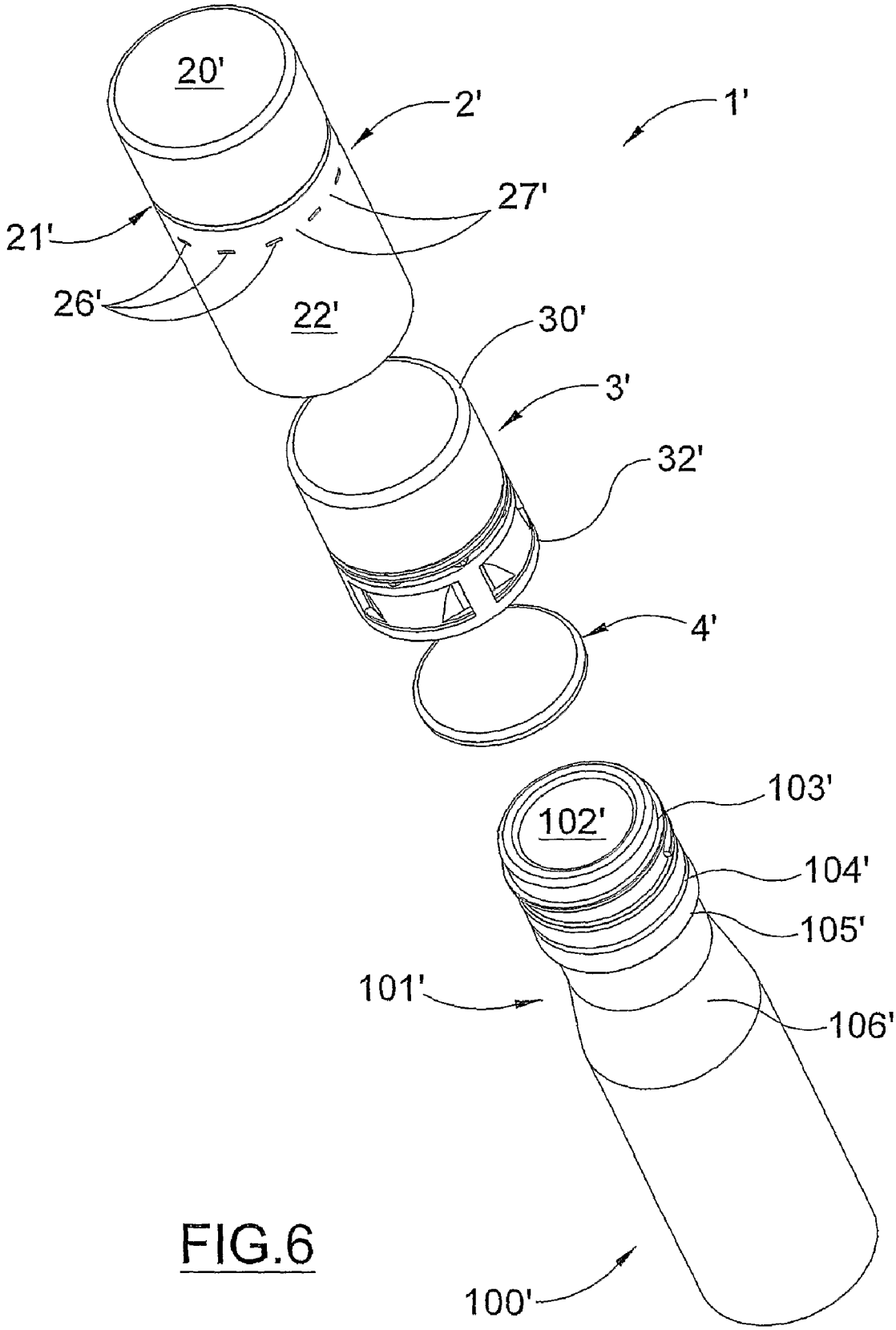
FIG. 6 is an exploded perspective view of a closure according to a second preferred embodiment of the present invention.

The tongues 35, which are formed as upper appendages of the lower ring 362 that project towards the interior of the closure 1 and have a longitudinal extent slightly less than that of the bridges 363, can be seen between the bridges 363 in FIGS. 4 and 5.

The inner surfaces 351 of the tongues 35 are such as to ensure the above-described movement between the rest configuration (shown) and the deformed configuration (not shown) during screwing onto the container 100; the inner surfaces 351 are preferably tapered so as to converge upwardly.

The outer surfaces 352 of the tongues 35 may define a recess 353 which advantageously has a radial extent at least equal to that of the bridges 363 and is disposed above the lower ring 362, allowing the tongues 35 to deform when they are urged outwardly by the projection 104 and allowing the inner annular element 32 to adopt the above-mentioned deformed configuration.

Figure 2:
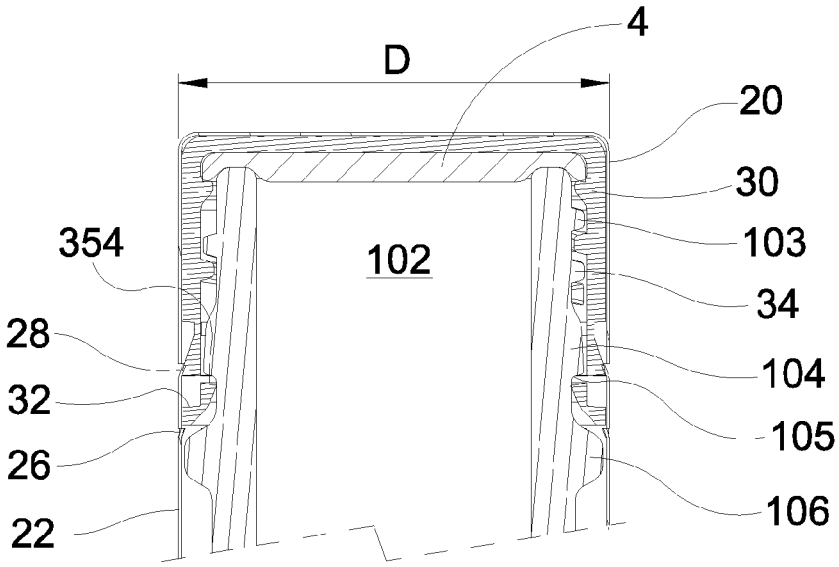
FIG. 2 shows, in section, the closure of FIG. 1 fitted on a container having a neck and a mouth, prior to initial opening.
Figure 3:
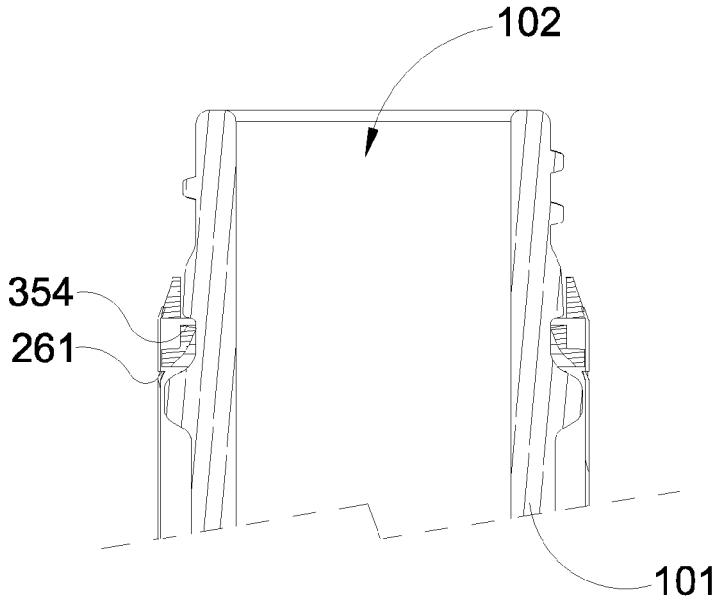
FIG. 3 is a section through the closure of FIG. 2 after it has been opened.

After the tongues 35 have passed over the projection 104, they return to the position of FIG. 4 and, as can clearly be seen in FIGS. 2 and 3, their upper surfaces 354 are arranged in the vicinity of the abutment surface 105 so as to counteract any action to remove the closure 1 from its correct position on the neck 101 of the container 100.

The outer surface of the upper ring 361 is advantageously tapered so as to converge upwardly to prevent potential pinching of the user's hand when the cap 20, 30 is screwed back onto the container 100 and so as to facilitate such screwing back.

Downward movement of the inner annular element 32 along the neck 101 may also be stopped by the projection 106 the increasing diameter of which prevents the frame 36, or more precisely the lower ring 362, from moving further downwards under the effect of gravity.

As can be seen in FIGS. 2 and 3, the outer skirt 22 extends longitudinally so as to cover and extend beyond the lower longitudinal portion of the inner annular element 32 for a distance such as to "dress" the neck 101 of the container 100, at the same time permitting the application of inscriptions, for example, advertizing.

In general, the distance for which the outer skirt 22 extends beyond retaining means 25 towards the container 100 is at least 3 mm, preferably more than 5 mm.

In relation to the maximum outside diameter D of the closure 1, it may be stated that this distance is at least 0.1 D, preferably greater than 0.5 D.

The outer connection means 21 are formed in the region of the upper end of the outer skirt 22 where the lower, outer retaining means, indicated 25, for preventing the outer skirt 22 from being removed from the inner ring 32 by being moved upwards, can also be seen.

The lower, outer retaining means 25 comprise an abutment surface 261 such that, if the outer skirt 22 were to undergo an upward longitudinal movement, it would become jammed against the lower surface 364 of the lower ring 362 of the frame 36 of the lower ring 32.

This abutment surface 261 may advantageously be formed by the upper surfaces of suitable tongues 26 (indicated in FIG. 1), preferably formed by suitable notches in the skirt 22.

The tongues 26 are preferably rectangular and inclined towards the interior of the closure 1 by a distance equal to at least one thickness; in other words, in the vicinity of the abutment surface 261, the outer surface of the tongue 26 is substantially aligned with the inner surface of the skirt 22.

There are preferably between three and sixteen tongues 26, for example, six, eight, ten or twelve tongues 26. They are advantageously uniformly spaced apart by continuous portions 27 of skirt 22 which give the skirt 22 the necessary mechanical strength.

The overall extent of the continuous portions 27 is preferably greater than 180°.

As an alternative to the embodiment described above, the abutment surface 261 may also be formed by a circumferential recess, for example, produced by rolling.

The longitudinal position of the lower, outer retaining means 25, may also be such that their abutment surface 261 would abut against the lower surface of the upper ring 361, instead than against the lower surface 364 of the lower ring 362.

This configuration is particularly advantageous because it brings closer to each other the discontinuities on the outer surface, making them less visible.

Moreover, it allows the outer connection means 21 and the lower, outer retaining means 25 to be made on the very same transverse plane (this configuration is not shown in the figures), reducing even more the visual effect of the discontinuities.

In such a case, the inner ring 32 may comprise a suitable annular seat which allows the relative rotation between inner ring 32 and skirt 22.

By virtue of the lower, outer retaining means 25, it is possible to produce an anti-tamper closure 1 that is composed of an outer capsule 2 and of an inner pre-threaded element 3 simply by inserting the inner pre-threaded element 3 in the outer capsule 2 without any need to perform any subsequent operation, since the lower, outer retaining means 25 allow the insertion of the inner pre-threaded cap 3 in the outer capsule 2 but not the reverse operation.

Moreover, the closure thus obtained can be smooth externally, that is, the circle circumscribed by the skirt 22 has a constant diameter, at least in the portion comprising the lower, outer retaining means 25 but preferably throughout the longitudinal extent of the skirt 22.

FIGS. 6 to 10 show a second embodiment, substantially similar to the previous embodiment. Only the differences will therefore be described and elements corresponding to the elements already described with reference to the first embodiment will be indicated by the same reference numerals followed by an apostrophe (').

The container 100' is no longer a standard bottle; the circumferential projection 104' of the container 100' shown is in fact longer than the projection 104. This permits the introduction of a system for providing evidence that the initial opening of the closure 1 has taken place, for example, such as the system described in the Applicant's European patent 1 511 677.

Figure 7:
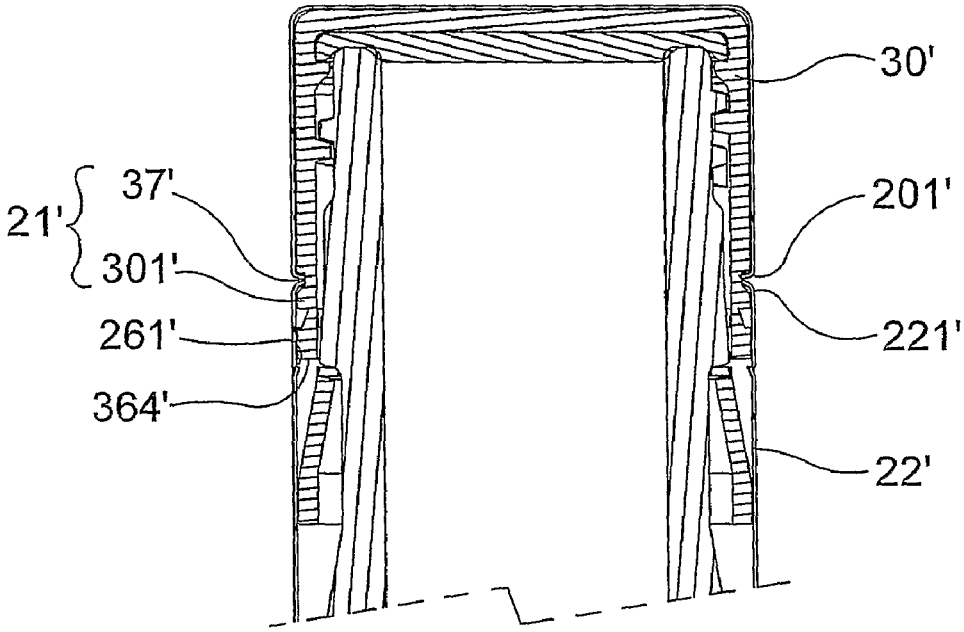
FIG. 7 shows, in section, the closure of FIG. 6 fitted on a container having a neck and a mouth, prior to initial opening.
Figure 8:
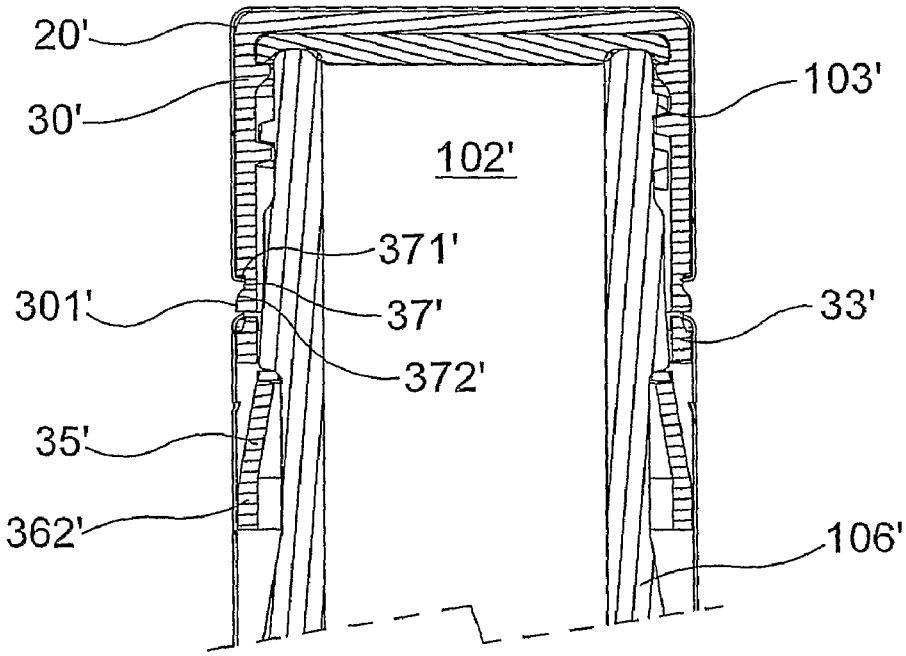
FIG. 8 is a section through the closure of FIG. 7 after it has been re-closed onto the container.
Figure 9:
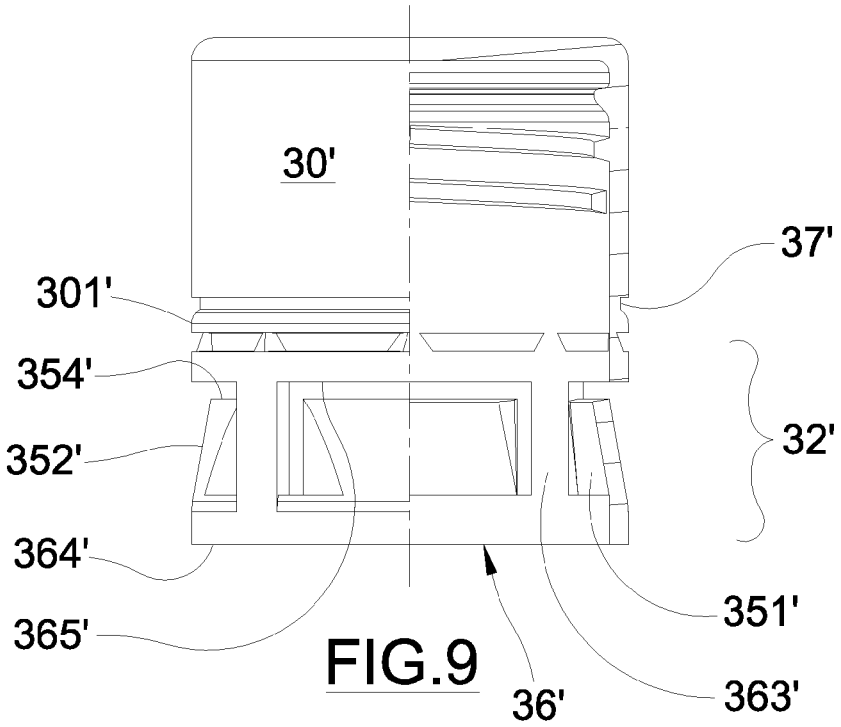
FIG. 9 is a partially-sectioned view of an element of the closure of FIG. 6.
Figure 10:
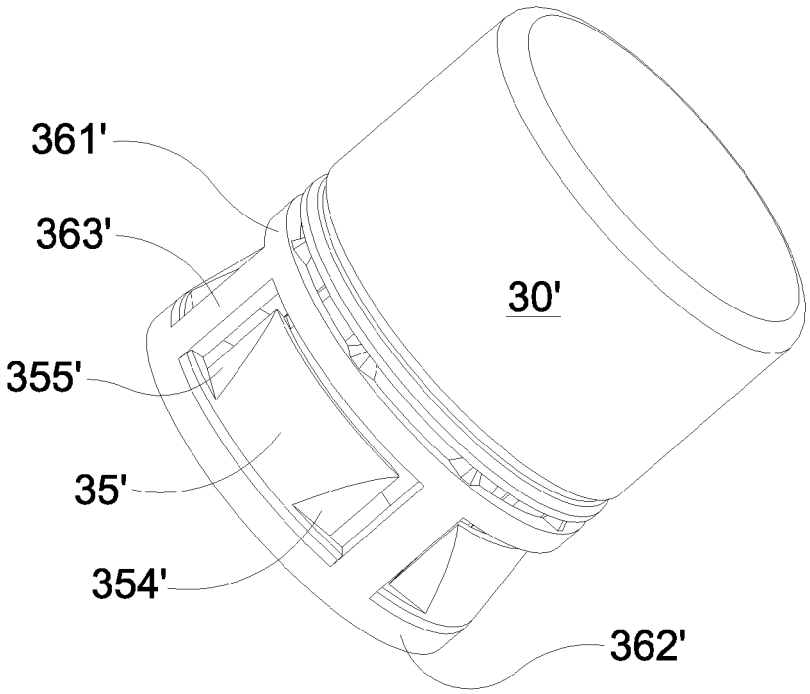
FIG. 10 is a perspective view of the element of FIG. 9.

As can be seen in FIGS. 7 and 8, the lower portion 301' of the inner cap 30' has a lower circumferential groove 37'. The upper surface 371' of the groove 37' enables a mechanical seal to be formed between the outer cap 20' and the inner cap 30' by inward bending of the lower end 201' of the outer cap 20'.

Similarly, the upper end 221' of the outer skirt 22' may be bent inwardly so as to bear against the lower surface 372' of the groove 37'.

The upper end 221' of the outer skirt 22', the lower end 201' of the outer cap 20', and the lower portion 301' of the inner cap 30' together constitute the outer connection means 21'.

They can advantageously be produced by a rolling operation prior to the fitting of the closure 1' on the container 100'.

As can be seen from a comparison between FIGS. 7 and 8, after initial opening, the groove 37' is partially exposed to view since the lower surface 372' of the groove 37' is able, by resilient deformation, to pass over the bent upper end 221' of the outer skirt 22' but, after initial opening, the geometrical configuration of the inner cap 30' and of the outer skirt 22' urge the skirt 22' downwards, preventing re-establishment of the initial conditions.

The inner ring 32' of the embodiment of FIGS. 6 to 10 is similar to the inner ring 32 described above but, since it has longer connecting bridges 363', it can be produced with different tongues 35'.

As can be seen in the drawings, each tongue 35' can have two outer surface portions 354' and 355' which connect its sides to its outer surface. Moreover, the outer surfaces 352' of the tongues 35' are tapered so as to diverge downwardly to reach the outside diameter of the lower ring 362'.

Clearly, the groove 37' may be formed on only a portion of the circumference of the inner pre-threaded element 3' or may be formed on the lower ring 32'; in this latter case, the bridges 33' will be inside the outer cap 20'.

As can be seen in FIGS. 7 and 8, in this embodiment, the abutment surface 261' does not come into abutment with the lower surface 364' of the lower ring 362' of the frame 36' but with the lower surface 365' of the upper ring 361' of the frame 36'.

The abutment surface 261' may, however, also be formed as in the previous embodiment.

The inner elements may advantageously be made of polymer material, for example, by injection moulding, whereas the outer elements may be made of metal, for example, aluminium.

Naturally, in order to satisfy contingent and specific requirements, a person skilled in the art will be able to apply to the above-described configurations many modifications and variations all of which, however, are included within the scope of protection of the invention as defined by the appended claims.

The invention claimed is:

1. An anti-tamper closure for containers having a neck and a mouth with an outer thread on the neck and with a projection disposed below the thread, the closure comprising:

an outer capsule comprising an outer cap and an outer skirt, and an inner pre-threaded element suitable for closing the mouth of the container, comprising an inner cap having an inner thread suitable for engaging the outer thread of the container and an inner annular element, in which:

the outer cap is connected to the inner cap in a manner such as to allow the closure to be opened and closed normally, the outer skirt is connected to the outer cap by outer connection means which, after initial opening, render the outer skirt free to rotate and to translate relative to the outer cap, the inner annular element is connected to the inner cap by inner connection means which, after initial opening, render the inner annular element free to rotate and to translate relative to the inner cap, the inner annular element is connected to the outer skirt with respect to translation by retaining means projecting inside the closure, and the outer skirt extends longitudinally towards the container beyond the retaining means.

2. An anti-tamper closure according to claim 1 in which the retaining means comprise at least one abutment surface suitable for engaging in abutment with an opposing surface formed on the inner annular element.

3. An anti-tamper closure according to claim 2 in which the at least one abutment surface is the upper surface of at least one tongue projecting inside the closure and formed in the outer skirt.

4. An anti-tamper closure according to claim 3 in which the outer skirt has a thickness, and the at least one tongue is bent inside the closure by a distance equal to the thickness of the outer skirt.

5. An anti-tamper closure according to claim 1 in which the inner and/or outer connection means are bridges.

6. An anti-tamper closure according to claim 1 in which the inner annular element comprises a plurality of tongues which project inside the closure and which can be deformed outside the closure on fitting the closure onto the container.

7. An anti-tamper closure according to claim 6 in which the tongues have respective inner surfaces which taper so as to diverge downwardly.

8. An anti-tamper closure according to claim 6, in which the projection has a lower surface and the tongues are such that they can become jammed against the lower surface of the projection of the container as a result of a longitudinal upward movement after fitting on the container, so as to prevent the inner annular element from passing over the projection after the closure has been fitted on the container.

9. An anti-tamper closure according to claim 7, in which the projection has a lower surface and the tongues are such that they can become jammed against the lower surface of the projection of the container as a result of a longitudinal upward movement after fitting on the container, so as to prevent the inner annular element from passing over the projection after the closure has been fitted on the container.

10. An anti-tamper closure according to claim 1 in which the outer skirt has an upper end, the outer cap has a lower end, the inner pre-threaded element comprises a groove, and the upper end of the outer skirt and the lower end of the outer cap are curved inside the closure inside the groove in a manner such that, after initial opening, one of the upper end and the lower end comes out of the groove, providing evidence that initial opening has taken place.

11. An anti-tamper closure according to claim 2 in which a circumferential groove is formed in the outer skirt, the circumferential groove extending inside the closure and having an upper surface, wherein the at least one abutment surface is the upper surface of the circumferential groove.

12. A method of producing an anti-tamper closure for containers having a neck and a mouth with an outer thread on the neck and with a projection disposed below the thread, the closure comprising:

an outer capsule comprising an outer cap and an outer skirt, and an inner pre-threaded element suitable for closing the mouth of the container, comprising an inner cap having an inner thread suitable for engaging the outer thread of the container and an inner annular element, in which:

the outer cap is connected to the inner cap in a manner such as to allow the closure to be opened and closed normally;

the outer skirt is connected to the outer cap by outer connection means which, after initial opening, render the outer skirt free to rotate and to translate relative to the outer cap, the inner annular element is connected to the inner cap by inner connection means which, after initial opening, render the inner annular element free to rotate and to translate relative to the inner cap, the inner annular element is connected to the outer skirt with respect to translation by retaining means projecting inside the closure, and the outer skirt extends longitudinally towards the container beyond the retaining means, the method, comprising the steps of:

producing the outer capsule, producing the inner pre-threaded element, and inserting the inner pre-threaded element in the outer capsule, without comprising any manufacturing step after the insertion step.

13. A method according to claim 12 in which the retaining means comprise at least one abutment surface suitable for engaging in abutment with an opposing surface formed on the inner annular element.

14. A method according to claim 13 in which the at least one abutment surface is the upper surface of at least one tongue projecting inside the closure and formed in the outer skirt.

15. A method according to claim 14 in which the outer skirt has a thickness, and the at least one tongue is bent inside the closure by a distance equal to the thickness of the outer skirt.

16. A method according to claim 12 in which the inner and/or outer connection means are bridges.

17. A method according to claim 12 in which the inner annular element comprises a plurality of tongues which project inside the closure and which can be deformed outside the closure on fitting the closure onto the container.

18. A method according to claim 17 in which the tongues have respective inner surfaces which taper so as to diverge downwardly.

19. A method according to claim 17, in which the projection has a lower surface and the tongues are such that they can become jammed against the lower surface of the projection of the container as a result of a longitudinal upward movement after fitting on the container, so as to prevent the inner annular element from passing over the projection after the Closure has been fitted on the container.

20. A method according to claim 18, in which the projection has a lower surface and the tongues are such that they can become jammed against the lower surface of the projection of the container as a result of a longitudinal upward movement after fitting on the container, so as to prevent the inner annular element from passing over the projection after the closure has been fitted on the container.

21. A method according to claim 12 in which the outer skirt has an upper end, the outer cap has a lower end, the inner pre-threaded element comprises a groove, and the upper end of the outer skirt and the lower end of the outer cap are curved inside the closure inside the groove in a manner such that, after initial opening, one of the upper end and the lower end comes out of the groove, providing evidence that initial opening has taken place.

22. A method according to claim 13 in which a circumferential groove is formed in the outer skirt, said circumferential groove having an upper surface, wherein the at least one abutment surface is the upper surface of the circumferential groove.

* * * * *